US010220414B2

(12) United States Patent
Heitfeld

(10) Patent No.: US 10,220,414 B2
(45) Date of Patent: Mar. 5, 2019

(54) MODULAR GYRATORY SIFTER

(71) Applicant: M-I L.L.C., Houston, TX (US)

(72) Inventor: Mark Heitfeld, Cleves, OH (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/892,726

(22) PCT Filed: Jun. 23, 2015

(86) PCT No.: PCT/US2015/037274
§ 371 (c)(1),
(2) Date: Nov. 20, 2015

(87) PCT Pub. No.: WO2015/200382
PCT Pub. Date: Dec. 30, 2015

(65) Prior Publication Data

US 2016/0175887 A1 Jun. 23, 2016

Related U.S. Application Data

(60) Provisional application No. 62/017,186, filed on Jun. 25, 2014.

(51) Int. Cl.
*B07B 1/42* (2006.01)
*B07B 1/28* (2006.01)
(Continued)

(52) U.S. Cl.
CPC ..... *B07B 1/28* (2013.01); *B07B 1/06* (2013.01); *B07B 1/38* (2013.01); *B07B 1/42* (2013.01); *B07B 1/4663* (2013.01)

(58) Field of Classification Search
CPC .... B07B 1/28; B07B 1/30; B07B 1/34; B07B 1/38; B07B 1/42; B07B 2201/02; B07B 2201/04
(Continued)

(56) References Cited

U.S. PATENT DOCUMENTS 562,750 A * 6/1896 Woodruff ..... B07B 1/46 209/244
1,234,447 A 7/1917 Cole
(Continued)

FOREIGN PATENT DOCUMENTS

EP 0155180 A2 9/1985
EP 0447618 A2 9/1991
(Continued)

OTHER PUBLICATIONS

International Search Report for corresponding International App No. PCT/US2015/037274, dated Sep. 22, 2015, 3 pages.
(Continued)

*Primary Examiner* — Joseph C Rodriguez
(74) *Attorney, Agent, or Firm* — Paula B. Whitten

(57) ABSTRACT

Apparatus having a drivebox including a motor, a drive connected to the motor, a suitable number of adjustment brackets, and a set of adjustment gussets. A basket is connected to the drivebox through the adjustment brackets and adjustment gussets, and drivebox imparts a sifting motion onto the basket. The basket has a housing, an infeed end, an discharge end, at least one screening deck contained therein, and positioned at a screening deck angle. The apparatus is of a modular design which enables changing the screening deck angle while installed in a facility and without substantial disassembly.

12 Claims, 4 Drawing Sheets

(51) Int. Cl.
*B07B 1/06* (2006.01)
*B07B 1/38* (2006.01)
*B07B 1/46* (2006.01)

(58) Field of Classification Search
USPC ..... 209/319, 404, 413
See application file for complete search history.

(56) References Cited

U.S. PATENT DOCUMENTS 1,347,314 A * 7/1920 Wilkinson ..... B07B 1/30 209/315
1,730,435 A * 10/1929 Munro ..... B07B 1/286 209/315
1,923,229 A * 8/1933 Robins ..... B07B 1/286 209/326
2,284,671 A * 6/1942 Meinzer ..... B06B 1/16 134/156
2,358,449 A * 9/1944 Finney ..... B07B 1/284 209/326
2,705,561 A * 4/1955 Denovan ..... B07B 1/38 209/332
2,777,578 A * 1/1957 Meinzer ..... B07B 1/38 209/243
2,946,440 A * 7/1960 Simpson ..... B07B 1/38 209/323
3,101,315 A * 8/1963 Denovan ..... B07B 1/10 209/332
3,650,401 A * 3/1972 Riesbeck ..... B07B 1/346 198/766
3,687,420 A * 8/1972 Schweinfurth ..... B01F 11/0077 366/109
3,756,407 A * 9/1973 Christensen ..... B07B 1/38 209/332
4,107,035 A 8/1978 Foresman
4,167,478 A * 9/1979 Salete ..... B07B 1/38 209/318
5,108,588 A * 4/1992 Yu ..... B01D 33/0346 209/237
5,547,068 A * 8/1996 Spurlin ..... B65G 27/26 198/760
5,713,457 A * 2/1998 Musschoot ..... B65G 27/30 198/753
7,581,646 B2 * 9/2009 Barr ..... A23N 15/025 209/235
7,644,824 B2 * 1/2010 Hollyfield ..... B07B 1/48 209/403
8,002,116 B1 * 8/2011 Cato ..... B07B 1/46 209/315
2008/0017554 A1 1/2008 Musschoot et al.
2011/0036759 A1 2/2011 Ballman et al.
2011/0186484 A1 8/2011 Heitfeld et al.
2013/0037452 A1 2/2013 Carter
2014/0097127 A1 4/2014 Aughey et al.

FOREIGN PATENT DOCUMENTS

GB 863433 A 3/1961
RU 1818151 A1 5/1993
SU 63005 A1 11/1943
SU 84705 A1 11/1949

OTHER PUBLICATIONS

Written Opinion for corresponding International App No. PCT/US2015/037274, dated Sep. 22, 2015, 5 pages.
Silenok, et al., "Mechanical equipment of enterprises of building materials, products and structures," Mechanical engineering, 1990, pp. 388-405 (in Russian, English isn't available).
International Preliminary Report on Patentability for the equivalent International patent application PCT/US2015/037274 dated Jan. 5, 2017.
Extended Search Report for the equivalent European Patent Application 15812117.8 dated Feb. 5, 2018.
Office Action for the equivalent Russian patent application 2017101959 dated Feb. 19, 2018.
Office Action for the equivalent Chinese patent application 2015800337179 dated Jul. 4, 2018.

* cited by examiner

MODULAR GYRATORY SIFTER

CROSS-REFERENCE TO RELATED APPLICATION

The present application claims priority from U.S. Provisional Patent Application 62/017,186, filed Jun. 25, 2014, which is incorporated herein by reference in its entirety.

BACKGROUND OF THE DISCLOSURE

The statements in this section merely provide background information related to the present disclosure and may not constitute prior art.

Embodiments disclosed herein relate generally to sifting apparatus and methods of using sifters. These devices and methods are usable in various industries—oilfield, pharmaceutical, food, medical, and other industries. For example, these sifters can be used to separate solid particles of a first size from solid particles of a second size.

One example of a sifter is a gyratory sifter including a class of devices used to separate sized particles, as well as to separate solids from liquids. Sifters can be used to screen, for example, feed material, fracturing sand, resin coated sand, ceramic proppant, activated carbon, fertilizer, limestone, petroleum coke, roofing granules, salt, sugar, plastic resins, powders, and the like, during industrial sorting and/or manufacturing operations.

Typical gyratory sifter designs have a drive unit that is built into the basket of the unit. Each unit is built to a specific angle for the screen decks relative the foundation upon which it is installed. Because sifters may be in continuous use, repairs and adjustments, or other associated downtimes, need to be minimized as much as possible. In some cases, it is desirable for the operator to change the angle of the basket to optimize the sifting operation. However, such a change in angle often requires a new sifting unit be installed, or hangers are shimmed in a way which may disrupt the balanced dynamics of the sifter.

Thus, there is a need for improved sifters and methods involving the use of sifters, which address the above described problems, and such need met at least in part by the invention described in the following disclosure.

DRAWINGS

The drawings described herein are for illustrative purposes only of selected embodiments and not all possible implementations, and are not intended to limit the scope of the disclosure.

DETAILED DESCRIPTION

Example embodiments will now be described more fully with reference to the accompanying drawings. At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the apparatus used/disclosed herein can also comprise some components other than those cited.

In a first aspect, the disclosure is related to an apparatus useful for sifting operations. The apparatus has a frame which supports a drivebox movably connected to the frame. The drivebox includes a motor, a drive connected to the motor, a suitable number of adjustment brackets, and a set of adjustment gussets. A basket is connected to the drivebox by the adjustments brackets and adjustment gussets. The basket has a housing, an infeed end, an discharge end, and at least one screening deck contained therein. In operation, the drivebox imparts a sifting motion onto the basket. The sifting motion imparted my be any suitable motion, known to those of skill in the art, for a given sifting application, and may be a motion such as vibratory, gyratory, gyratory-reciprocal, and the like.

Figure 1:
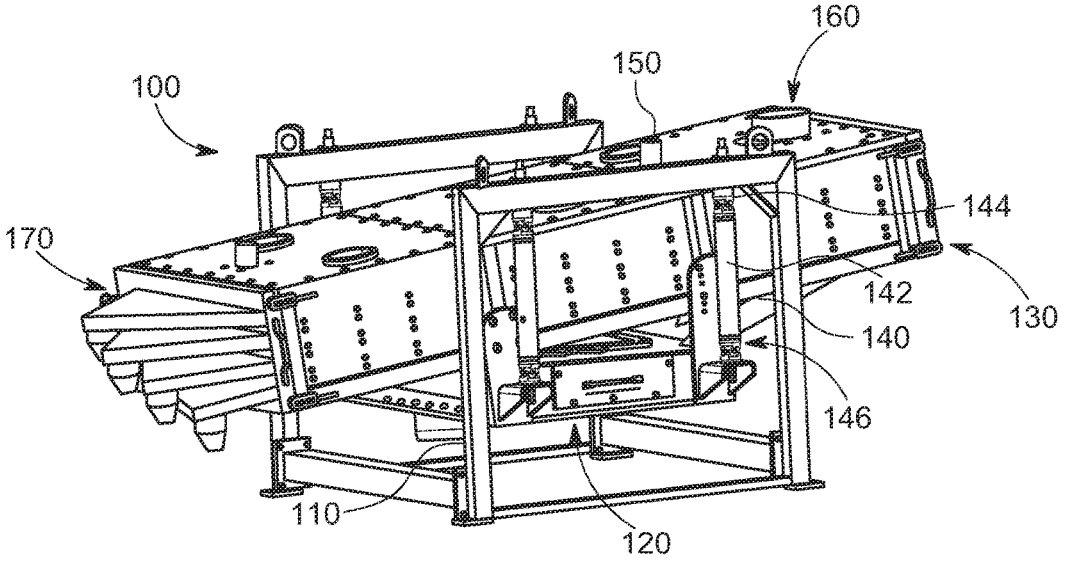
FIG. 1 is a plan view of a modular sifting apparatus.

Referring to FIG. 1, which illustrates a first apparatus embodiment according to the disclosure, apparatus 100 includes a frame 110, a drivebox 120 connected to the frame 110, and basket 130 connected to the drivebox 120. Frame 110 is shown as a skid in FIG. 1, but may be any effective structure for suspending the drivebox 120 and basket 130, including, but not limited to a skid, steel beams, building structural components, and the like. Drivebox 120 may be connected to frame 110 by hangers 140 (four shown) which include a shaft 142 with universal joints 144, 146, positioned on opposing distal ends of the shaft. Universal joints 144 are connected to frame 110 while universal joints 146 are connected to the drivebox, thus suspending drivebox 120 and basket 130. Basket 130 has a housing 150 which encloses inner components of the basket 130, an infeed end 160, and an discharge end 170.

Figure 2:
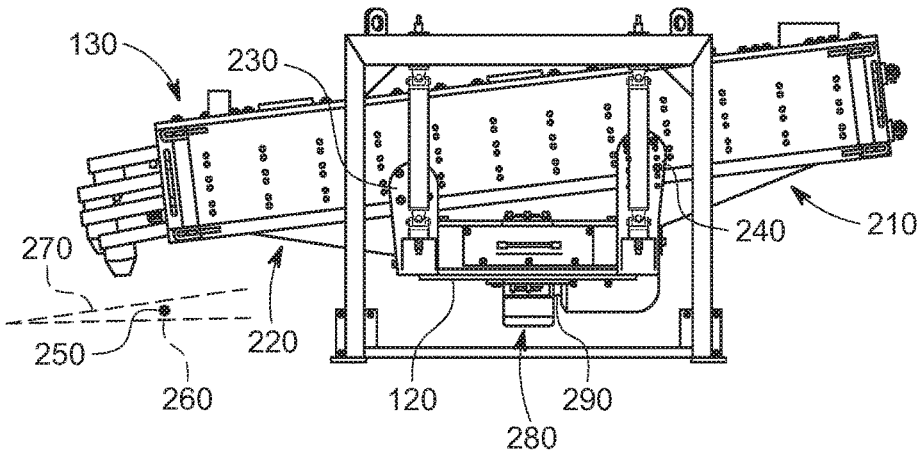
FIG. 2 is a perspective view of a modular sifting apparatus.

Referring now to FIG. 2, drivebox 120 includes adjustment gussets 210, 220, and adjustment brackets 230, 240. Basket 130 is movably connected to adjustment gussets 210, 220, and adjustment brackets 230, 240, which enables basket 130 to be connected at different points on adjustment gussets 210, 220, and adjustment brackets 230, 240. This enables the basket 130 to be set at a desired screening deck angle 250 relative a level plane 260, as shown in the dashed lines 260 and 270. As used herein, the phrase "level plane" means a plane parallel with the horizon.

In embodiments of the disclosure, any suitable screening deck angle of the basket relative the level plane may be used, and will be readily apparent to those with skill in the art. Some non-limiting examples of useful screening deck angles include any angle between about 2 degrees to about 15 degrees, about 3 degrees, about 5 degrees, or even about 7 degrees, relative level plane.

Referring again to FIGS. 1 and 2, drivebox 120 further includes a motor 280 which is coupled to a drive contained within the drivebox 120, the motor 280 coupled to the drive with belt 290. The drive housed with drivebox 120 can be of any suitable design and/or orientation to impart the desired sifting motion into the basket 130.

Figure 3:
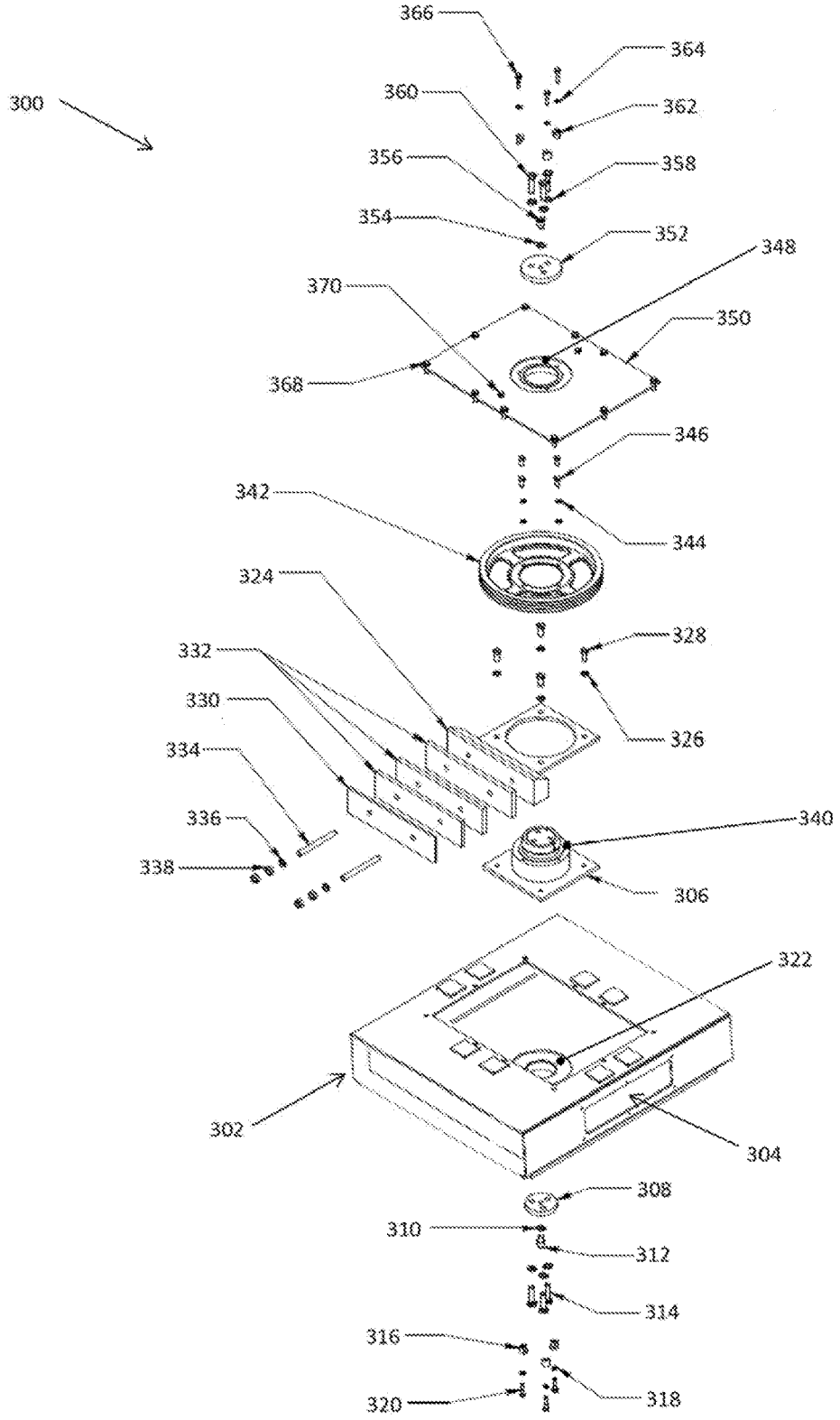
FIG. 3 is a broken out plan view of one example of components contained within a drivebox which imparts sifting motion into a basket.

FIG. 3 illustrates, in a disassembled broken out view, one example of components contained within the inside of a drivebox which serve to impart the desired sifting motion into the basket 130. Drivebox 300 includes a housing 302, which has an opening 304 in one side to accommodate a belt connected with a motor. Drivekit 306 is position in the bottom of the housing 302, and connected to end cap 308 with lockwasher 310, capscrew 312, capscrews/washers 314, drive retainer 316, lockwashers 318, and capscrews 320. The lower distal end of drivekit 306 is mated with bearing assembly 322 in the bottom of housing 302. A rotor plate weldment 324 is secured to drivekit 306 with washers 326 and capscrews 328. Attached to rotor plate weldment 324 are rotor weight plates 330, 332, using threaded bars 334, lockwashers 336, and hexnuts 338. Drivekit 306 includes lip 340 for connectively receiving drive sheave 342 which is in communication with the motor through the belt. Drive sheave 342 is secured to lip 340 with lockwashers 344 and capscrews 346. The upper distal end of drivekit 306 is mated with bearing assembly 348 in drivebox top plate 350. Drivekit 306 is connected to end cap 352 with lockwasher 354, capscrew 356, lockwashers 358, capscrews 360, drive retainer 362, lockwashers 364, and capscrews 366. Drivebox top plate 350 is secured to drivebox housing 302 with lockwashers/capscrews 368 and 370. While FIG. 3 illustrates one example of a drivebox useful in according with the disclosure, any suitable design, readily apparent to those of skill in the art may be used.

Figure 4:
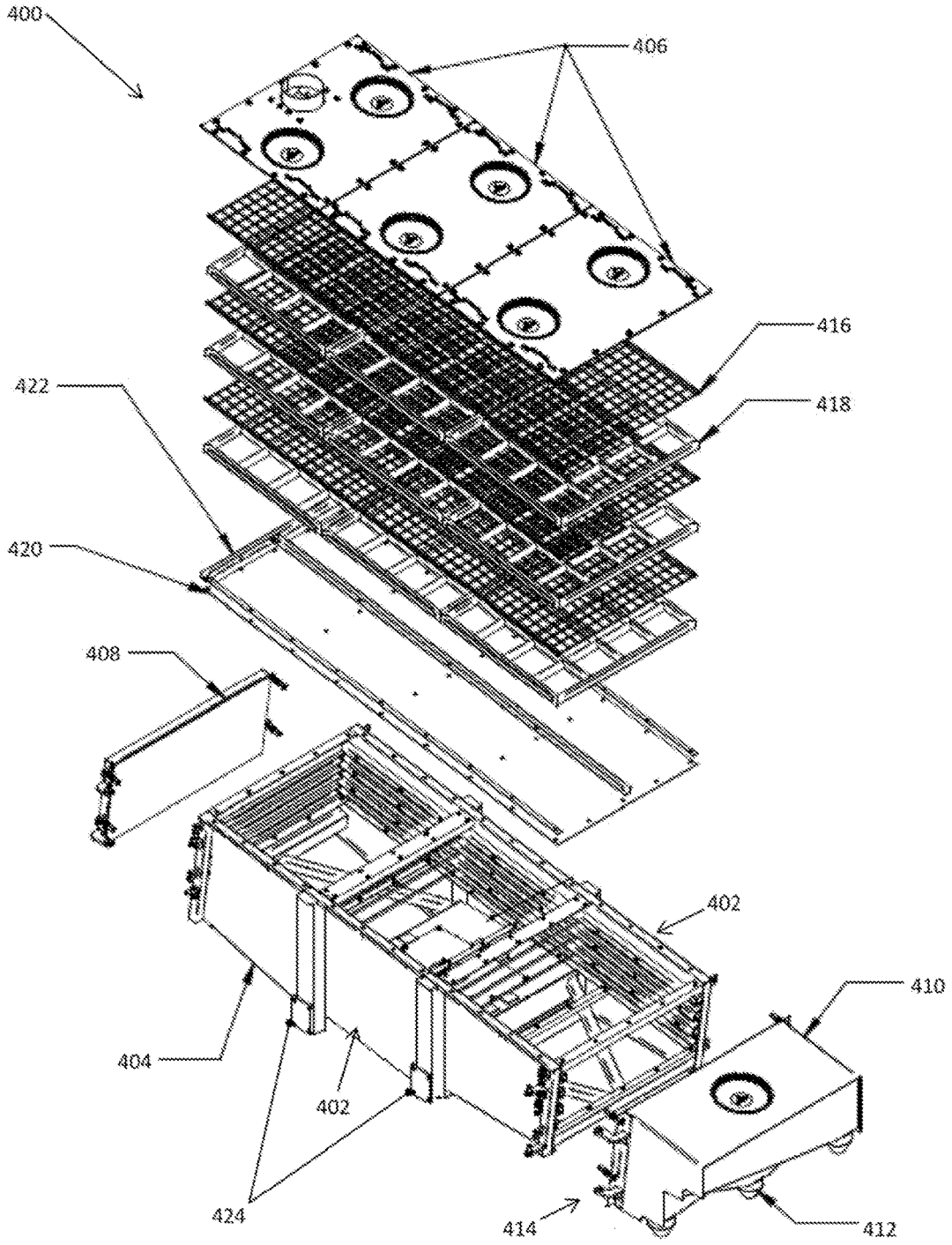
FIG. 4 is a broken out plan view of a basket.

Referring now to FIG. 4 which illustrates one example of a basket useful according to the disclosure, in a broken out plan view. On the exterior, basket 400 includes sides 402, bottom 404, top covers 406, screen removal door 408 on the infeed end, and discharge chute 410 on a discharge end. Discharge chute 410 further includes discharge outlets 412 (three shown), and is connected to one side 402 with hinges 414. Basket 400 further includes screens 416 (three shown), ball decks 418 (three shown) and bottom pan 420 with angles and plates 422 for securing within basket 400. The exterior of basket 400 further includes mounts 424 for connection to adjustment brackets from the drivebox.

Figure 5:
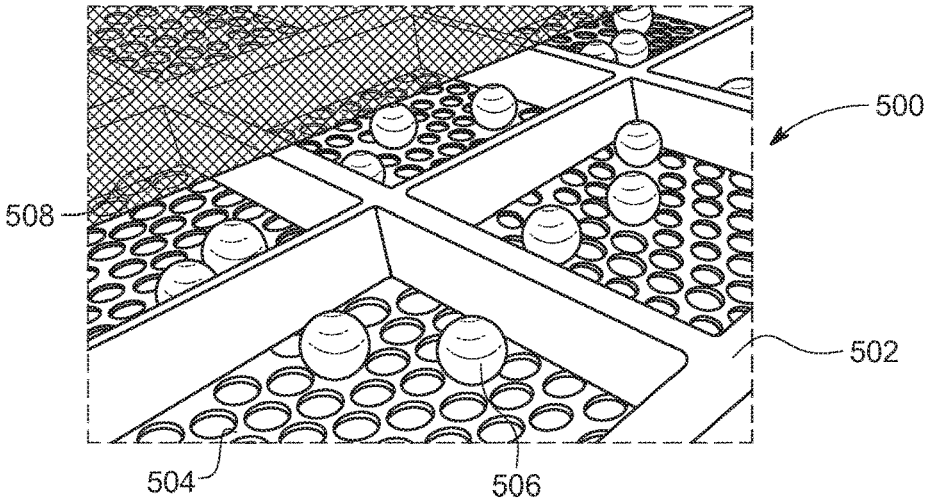
FIG. 5 illustrates a configuration of screens, balls and ball decks.

FIG. 5 illustrates one configuration of screens, balls and ball decks according to some embodiments of the disclosure. Ball deck 500 includes a deck frame 502, a bottom perforated plate 504 attached to the lower side of deck frame 502, and balls 506 (fifteen shown) located within openings defined by the deck frame. Screening mesh 508 may be disposed upon the upper surface of the deck frame 502. In some cases, ball decks 500 may be fabricated from heavy duty rectangular steel tubing and heavy gauge perforated plates to provide excellent durability. The ball decks 500 may also be modular so they can be handled in sections. For example, once a screen is removed, the ball deck below that screen can also be removed without disturbing any other screen or ball tray.

Figure 6:
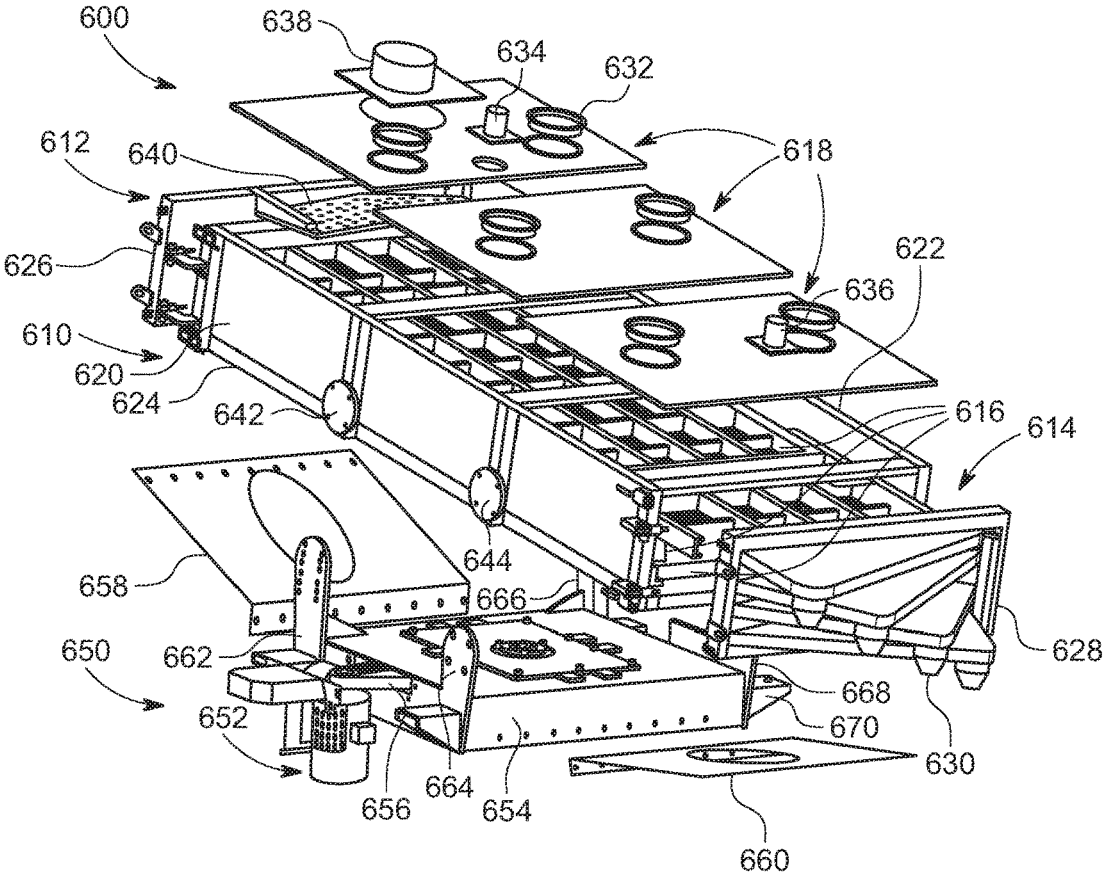
FIG. 6 is a broken out plan view of a basket and drivebox.

Referring now to FIG. 6, which illustrates some embodiments of gyratory sifting apparatus according to the disclosure in an exploded view, apparatus 600 includes basket 610 and drivebox 650. Basket 610 includes a housing, an infeed end 612, a discharge end 614, and at least one screening deck 616 (three shown). The housing of basket 610 is formed with top covers 618 (three shown), sides 620, 622, and bottom 624. Located on the infeed end 612 a is screen removal door 626, which is connected to side 620 with hinges, and securely latches to side 622. The discharge end 612 includes discharge chute 628 connected to side 620 with hinges, and which securely latches to side 622. Discharge chute 628 further includes discharge outlets 630 (four shown). The arrangement of top covers 618 include inspection plugs 632 (six shown), a plurality of vents 634, 636, and an infeed port 638 located proximate infeed end 612. Within the housing, located beneath infeed port 638 is a perforated prefilter plate 640 connected to sides 620, 622. The exterior surfaces of sides 620, 622 include mounts 642 and 644 for movably connecting basket 600 with drivebox 650.

Drivebox 650 includes a motor 652, a gyratory drive enclosed in drive housing 654, where the gyratory drive connected to motor 652 through belt 656. Drivebox 650 further includes adjustment gussets 658, 660, and adjustment brackets 662, 664, 666 and 668, which are movably connected to basket 600. Adjustment brackets 662, 664, 666 and 668 movably connect to basket 600 at mounts 642 and 644. Adjustment gussets 658, 660 movably connect to basket 600 at bottom 624 of the housing. In some cases, adjustment brackets 664 and 668 are pivot brackets and adjustment brackets 662 and 666 are vertical adjustment brackets. Drivebox 650 further includes mounting ears 670 (four shown), for connection or suspension from a frame such as a skid, steel beams, building structural components, and the like.

In some aspects of the disclosure, the unique design of the sifting apparatus enable the basket to have a first screening deck angle relative a level plane at a first time, and then adjusting to a second screening deck angle relative a level plane at a second time, without removal or substantial disassembly of the sifting apparatus. This allows the sifting apparatus to remain installed in the facility during the time period which elapses during the angle adjustment period, which is generally from the first time to the second time.

Some other embodiments of the disclosure include methods of adjusting a screening deck angle of a gyratory sifting apparatus. For structural illustration with reference to FIGS. 1 and 2, the method includes providing a gyratory sifter having a drivebox 120 having a motor 280, a gyratory drive connected to the motor 280 with belt 290, a plurality of adjustment brackets 230, 240, and a plurality of adjustment gussets 210, 220. The gyratory sifter also includes basket 130 connected to the drivebox 120, where the basket has a housing 150, an infeed end 160, a discharge end 170, and at least one screening deck positioned within housing 150. The basket 130 is connected to the drivebox 120 through the plurality of adjustment brackets 230, 240, and through the plurality of adjustment gussets 210, 220. At a first point in time, basket 130 is connected to the drivebox 150 in a first position with a first screening deck angle 250. Then, basket 130 is disconnected from the plurality of adjustment brackets 230, 240, and the plurality of adjustment gussets 210, 220, and subsequently reconnected to the plurality of adjustment brackets 230, 240, and the plurality of adjustment gussets 210, 220, at a second position to achieve a second screening deck angle 250. This change in the screening deck angle 250 is conducted while the gyratory sifting apparatus remains installed in a facility and without substantial disassembly.

In some aspects of the disclosure, screening mesh that is used on the screening deck may be tensioned in place, and can be easily re-tensioned as needed to return to peak efficiency in the event that the screening mesh undergoes stretching. The screening mesh may be a one-piece hook design for attachment to the decking frame, while in some other cases, screening mesh may be secured with attachment clips.

As shown in FIGS. 1, 2, 4 and 6, the sifter apparatus may include hinged screen removal doors and hinged discharge chutes which enable access to the interior of the basket housing for inspection without disturbing any of the screens or ball trays, or repair, maintenance or replacement of screening decks, and components of the decks.

It will be appreciated that the figures illustrate a drivebox positioned below a basket. However, in the spirit of the disclosure, the drivebox may be in any suitable position relative the basket, such as above the basket, or even position on a side of the basket. In some instances, a plurality of driveboxes could be utilized to achieve the desired sifting motion.

In some other aspects of the disclosure, it is possible to manufacture one drivebox design which could be universally used with different size or shaped basket. The size may be related to the number of screen decks in the basket. Also, another advantage may be changing drivebox with reduced complexity and downtime.

The foregoing description of the embodiments has been provided for purposes of illustration and description. Example embodiments are provided so that this disclosure will be thorough, and will fully convey the scope to those who are skilled in the art. Numerous specific details are set forth such as examples of specific components, devices, and methods, to provide a thorough understanding of embodiments of the disclosure, but are not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although various embodiments have been described with respect to enabling disclosures, it is to be understood the invention is not limited to the disclosed embodiments. Variations and modifications that would occur to one of skill in the art upon reading the specification are also within the scope of the invention, which is defined in the appended claims.

I claim:

1. An apparatus comprising:

a frame having a longitudinal axis extending along a level plane and comprising a perimeter defining an interior space of the frame;

a drivebox movably connected to the frame, the drivebox having a length, extending along the longitudinal axis of the frame, defined between a first end of the drivebox and an opposite second end of the drivebox and comprising a motor, a drive connected to the motor, a plurality of adjustment brackets, and a plurality of adjustment gussets, the plurality of adjustment brackets comprising a pair of first adjustment brackets provided at the first end of the drivebox and a pair of second adjustment brackets provided at the opposite second end of the drive box; and;

a basket movably connected to the drivebox such that the pair of first adjustment brackets and the pair of second adjustment brackets suspend drivebox and the basket from the frame, the basket comprising a housing, an infeed end, a discharge end, and at least one screening deck, wherein the basket is connected to the plurality of adjustment brackets and the plurality of adjustment gussets and has a screening deck angle of from about 2 degrees to about 15 degrees downward with respect to the level plane such that a portion of the housing of the basket and a portion of the at least one screening deck of the basket are provided inside the interior space of the frame.

2. The apparatus of claim 1 wherein the screening deck angle is about 3 degrees relative the level plane.

3. The apparatus of claim 1 wherein the screening deck angle is about 5 degrees relative the level plane.

4. The apparatus of claim 1 wherein the screening deck angle is about 7 degrees relative the level plane.

5. The apparatus according to claim 1 wherein the basket is generally rectangular-shaped.

6. The apparatus according to claim 1 wherein drivebox imparts gyratory motion into the basket.

7. The apparatus according to claim 1 wherein drivebox is positioned below the basket.

8. The apparatus according to claim 1 wherein the basket comprises from 3 to 6 screening decks.

9. An apparatus comprising:

a frame;

a drivebox movably connected to the frame, the drivebox comprising a motor, a drive connected to the motor, a plurality of adjustment brackets, and a plurality of adjustment gussets; and, a basket movably connected to the drivebox, the basket comprising a housing, an infeed end, a discharge end, and at least one screening deck;

wherein the basket is connected to the plurality of adjustment brackets and the plurality of adjustment gussets, wherein the plurality of adjustment brackets comprises a pair of pivot brackets and a pair of vertical adjustment brackets, wherein each of the pivot brackets is connected to opposing sides of the basket and the drivebox, and wherein each of the vertical adjustment brackets is connected to opposing sides of the basket and the drivebox.

10. The apparatus according to claim 9 wherein the pair of vertical adjustment brackets and the pair of pivot brackets are configured to connect the drivebox with the basket at any one of a plurality of screening deck angles relative a level plane.

11. The apparatus according to claim 10 wherein the basket is positioned at a screening deck angle of about 3 degrees, about 4 degrees, about 5 degrees, about 6 degrees, or about 7 degrees relative the level plane.

12. An apparatus comprising:

a frame having a longitudinal axis extending along a level plane and comprising a perimeter defining an interior space of the frame;

a drivebox movably connected to the frame, the drivebox comprising a motor, a drive connected to the motor, a plurality of adjustment brackets, and a plurality of adjustment gussets; and a basket movably connected to the drivebox, the basket comprising a housing, an infeed end, a discharge end, and at least one screening deck, wherein the basket is connected to the plurality of adjustment brackets and the plurality of adjustment gussets and has a screening deck angle of from about 2 degrees to about 15 degrees downward with respect to the level plane such that a portion of the housing of the basket and a portion of the at least one screening deck of the basket are provided inside the interior space of the frame, and further wherein portions of the plurality of adjustment gussets are provided outside the interior space of the frame.

* * * * *